US009071005B2

(12) United States Patent
Ikezawa

(10) Patent No.: US 9,071,005 B2
(45) Date of Patent: Jun. 30, 2015

(54) TERMINAL BLOCK AND ELECTRONIC DEVICE COMPRISING SAME

(71) Applicant: TDK CORPORATION, Tokyo (JP)

(72) Inventor: Akira Ikezawa, Tokyo (JP)

(73) Assignee: TDK CORPORATION, Tokyo (JP)

( * ) Notice: Subject to any disclaimer, the term of this patent is extended or adjusted under 35 U.S.C. 154(b) by 0 days.

(21) Appl. No.: 14/162,295

(22) Filed: Jan. 23, 2014

(65) Prior Publication Data

US 2014/0242838 A1 Aug. 28, 2014

(30) Foreign Application Priority Data

Feb. 22, 2013 (JP) ..... 2013-033418

(51) Int. Cl.
*H01R 13/52* (2006.01)
*H01R 13/405* (2006.01)

(52) U.S. Cl.
CPC ..... *H01R 13/521* (2013.01); *H01R 13/405* (2013.01)

(58) Field of Classification Search
CPC ..... H01R 9/2429; H01R 9/24
See application file for complete search history.

(56) References Cited

U.S. PATENT DOCUMENTS 5,518,427 A 5/1996 Kan et al.
7,387,551 B2 6/2008 Kurahashi

FOREIGN PATENT DOCUMENTS

JP A-6-29052 2/1994
JP A-2007-73449 3/2007

*Primary Examiner* — Briggitte R Hammond
(74) *Attorney, Agent, or Firm* — Oliff PLC

(57) ABSTRACT

To improve airtightness while reducing a usage amount of a resin for a sealing operation. A terminal block 20 of an electronic device 100 includes a resinous portion 21, a terminal member 23, and a connection member 25. Then, since a first area A1 and a second area A2 are divided by a partition wall 273 in the terminal block 20, it is possible to individually charge a charging resin 29A for blocking a through-hole A22 and a charging resin 29B for blocking a boundary portion between the terminal member 23 and the resinous portion 21. Thus, since the charging amounts of the charging resins 29A and 29B may be respectively adjusted, it is possible to appropriately charge the charging resin for improving the airtightness and to reduce the usage amount of the charging resin for a sealing operation.

16 Claims, 7 Drawing Sheets

TERMINAL BLOCK AND ELECTRONIC DEVICE COMPRISING SAME

TECHNICAL FIELD

The present invention relates to a terminal block that is installed in a casing of a power supply unit or the like and an electronic device that includes the terminal block.

BACKGROUND

In a case where an in-car power supply unit used in a hybrid car or an electric car is disposed in, for example, an engine room, when dust or a liquid such as water, water droplet, rain water, sea water, a radiator liquid, and engine oil intrudes into the power supply unit, there is a possibility that an internal circuit may be damaged. For this reason, there has been a demand for improving the airtightness for a penetration-type terminal block that is attached to a casing of the power supply unit and electrically connected to an external device. In the penetration-type terminal block of which the airtightness is improved, as shown in Japanese Patent Application Laid-Open No. 2007-73449 and Japanese Patent Application Laid-Open No. H06-29052, a structure is disclosed which keeps airtightness between a casing and a conductive member by a resin that covers the conductive member.

SUMMARY

In a case of the terminal block having a structure that covers the periphery of the conductive member by the resin, there is a possibility that a leakage may occur between the conductive member and the resin due to a difference in material. In order to prevent the occurrence of the leakage, a method is considered which seals a boundary face between the conductive member and the resin by using a liquid sealing resin or the like. However, the sealing resin is expensive, and when the application amount thereof increases, the product cost increases.

The present invention is made in view of the above-described circumstances, and an object of the present invention is to provide a terminal block capable of improving airtightness while reducing a usage amount of a resin for a sealing operation and also provide an electronic device including the terminal block.

In order to attain the above-described object, according to an embodiment of the present invention, there is provided a terminal block including: a terminal member of which one end side is equipped with a first terminal having an opening and the other end side different from the one end side is equipped with a second terminal; a connection member that includes a flange extending outward from about a center of a main body and is inserted from the side of the second terminal into the opening of the first terminal of the terminal member so that the flange is fixed while contacting the first terminal; and a resinous portion that covers the peripheries of the terminal member and the connection member while at least one of the first terminal and the connection member is exposed at the side of the first terminal and the second terminal is exposed at the side of the second terminal, wherein the resinous portion includes a cylindrical side wall that is formed at the end of the side of the second terminal so as to extend toward the side of the second terminal in the extension direction of the terminal member and to surround the terminal member and a partition wall that divides an area surrounded by the side wall into a first area and a second area, wherein the terminal member protrudes from a bottom surface of the first area, and wherein a bottom surface of the second area is provided with a through-hole communicating with an end surface the side of the second terminal of the connection member.

According to the above-described terminal block, the area surrounded by the cylindrical side wall near the second terminal of the terminal member is divided as the first area and the second area by the partition wall. Then, the terminal member protrudes from the bottom surface near the first area, and the bottom surface near the second area is provided with the through-hole that communicates with the end surface of the connection member. Here, in order to improve the airtightness, there is a need to seal the protruding portion of the terminal member in the first area and the through-hole communicating with the end surface of the connection member by the resin. However, since the first area and the second area are divided by the partition wall, it is possible to individually seal the side (the first area side) of the terminal member and the side (the second area side) of the through-hole communicating with the end surface of the connection member. Accordingly, it is possible to improve the airtightness while reducing the usage amount of the resin for the sealing operation.

Here, a padding portion may be formed in a boundary portion between the terminal member and the resinous portion at the bottom surface of the first area, and the height of the padding portion in the extension direction of the terminal member may be lower than the height of the side wall.

As described above, since the padding portion is formed at the boundary portion between the terminal member and the resinous portion, it is possible to further decrease the gap at the boundary portion between the terminal member and the resinous portion. Further, since the height of the padding portion in the extension direction of the terminal member is set to be lower than the height of the side wall, the resin charged into the first area for the sealing operation reliably blocks the padding portion, so that the airtightness may be highly maintained.

Here, as a structure that effectively exhibits the above-described effect, specifically, a charging resin that is charged into the first area and the second area may be further provided.

Further, a charging amount of the charging resin may be different in the first area and the second area.

In this way, since the charging amount of the charging resin is set to be different in the first area and the second area, it is possible to adjust the charging amount based on the charging amount of the resin necessary for sealing the respective areas, and hence to further reduce the resin usage amount.

Further, the terminal member may include a bent portion that is formed between the first terminal and the second terminal.

In this way, since the bent portion is formed between the first terminal and the second terminal, it is possible to prevent the occurrence of the leakage along the boundary face of the resin and the terminal member between the first terminal and the second terminal, and hence to improve the airtightness of the terminal block.

Further, according to another embodiment of the present invention, there is provided an electronic device including: the terminal block; a casing that includes an attachment portion for attaching the terminal block thereto and accommodates an electronic component electrically connected to the terminal block therein; and a sealing member that blocks a gap between the casing and the terminal block at the attachment portion.

According to the present invention, it is possible to provide the terminal block capable of improving the airtightness while reducing the usage amount of the resin for a sealing operation and also provide the electronic device including the terminal block.

DETAILED DESCRIPTION

Figure 1:
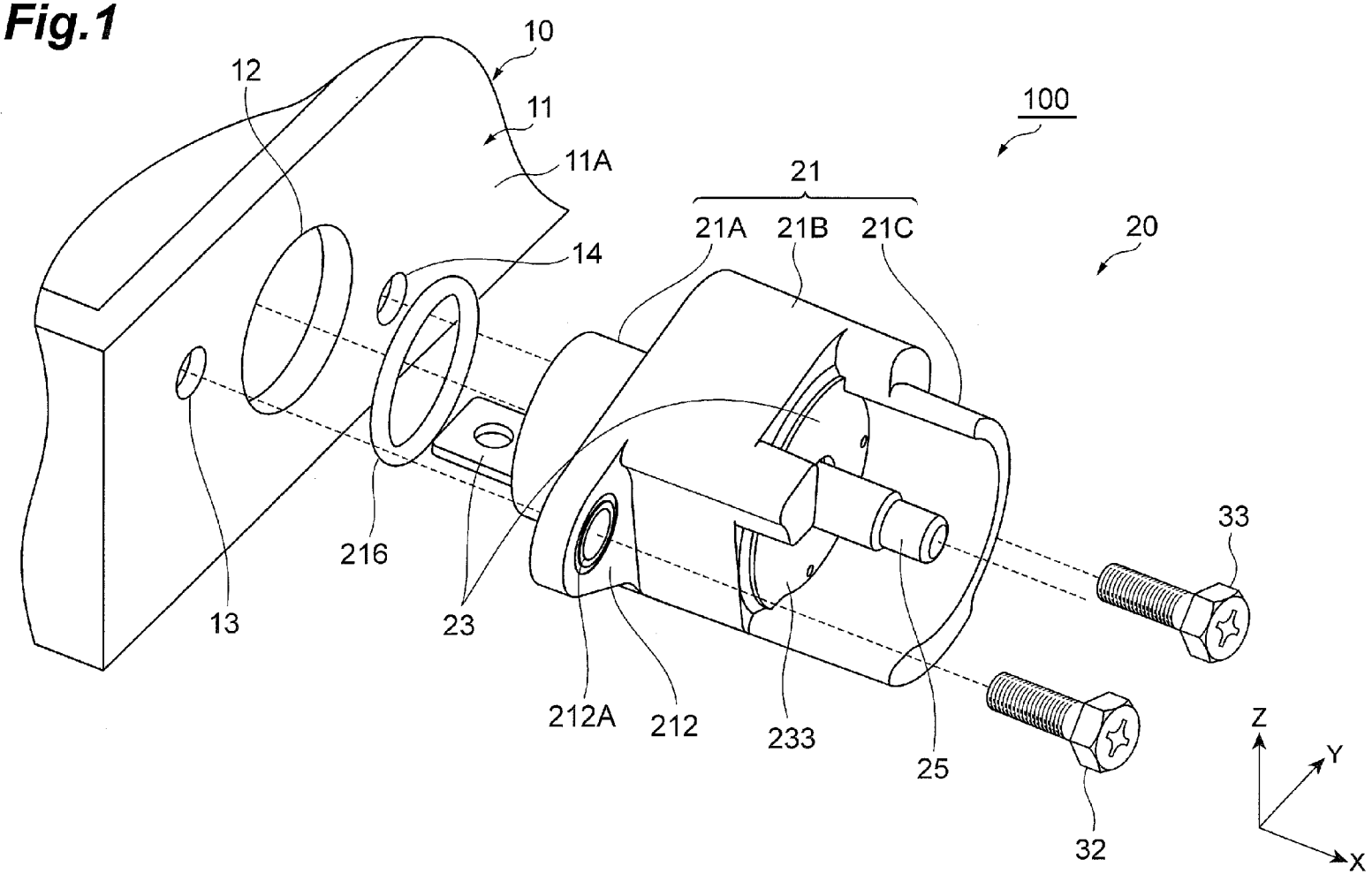
FIG. 1 is an exploded perspective view illustrating a configuration of a terminal block that is attached to a casing of an electronic device according to an embodiment.

Hereinafter, preferred embodiments of the present invention will be described in detail by referring to the accompanying drawings. Furthermore, the same reference numerals will be given to those of the same components in the description of the drawings, and the description thereof will not be repeated.

Figure 2:
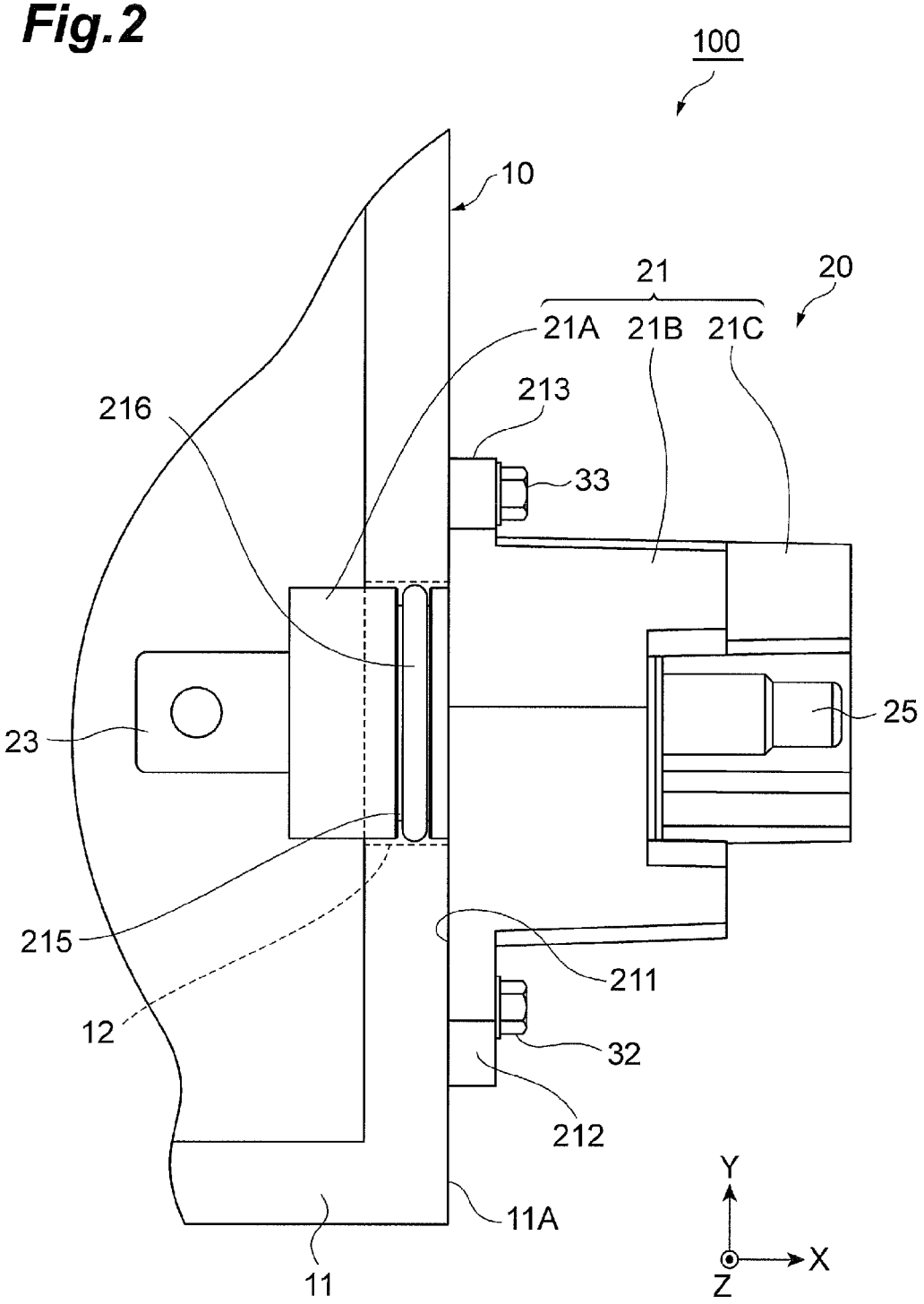
FIG. 2 is a schematic top view illustrating the periphery of the terminal block in the casing.
Figure 3:
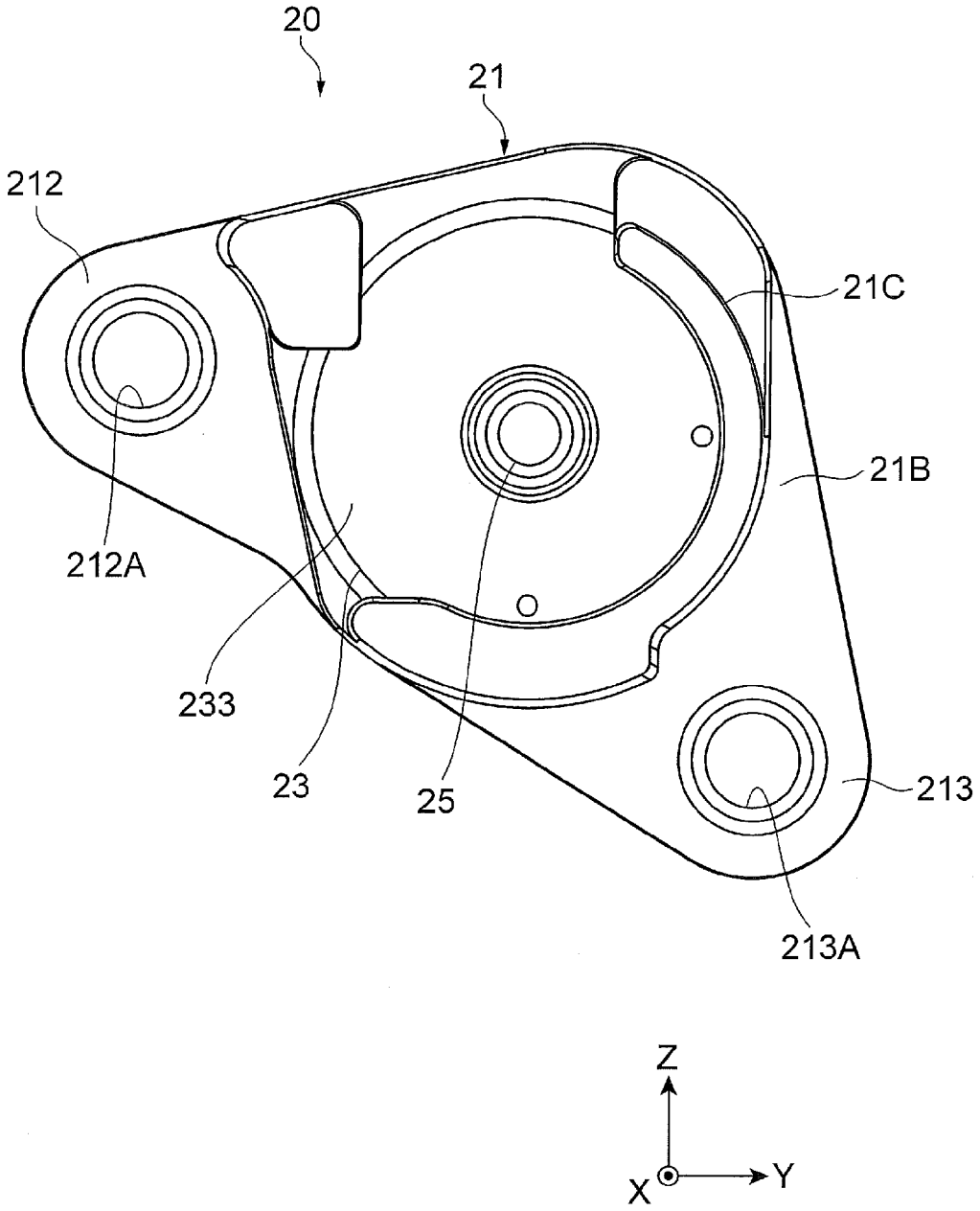
FIG. 3 is a right side view of the terminal block.
Figure 4:
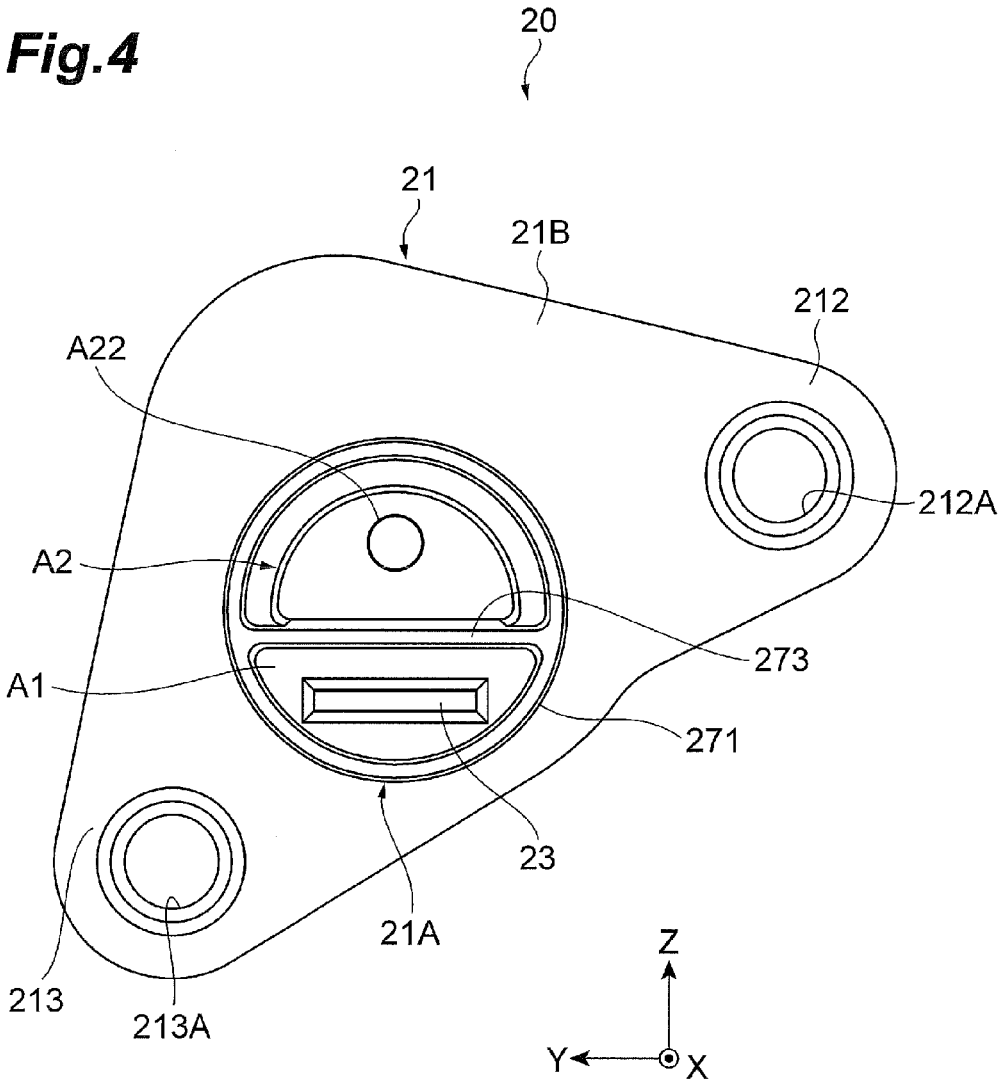
FIG. 4 is a left side view of the terminal block.

FIG. 1 is an exploded perspective view illustrating a configuration of a terminal block that is attached to a casing of an electronic device according to the embodiment, and FIG. 2 is a schematic top view illustrating the periphery of the terminal block in the casing. Further, FIG. 3 is a right side view (a side view from the +X direction) of the terminal block, and FIG. 4 is a left side view (a side view from the −X direction) of the terminal block. Furthermore, in the description below, the axes of XYZ will be used to mainly clarify the structure of the terminal block and the like.

As illustrated in FIG. 1, an electronic device 100 according to the embodiment includes a casing 10 and a penetration-type terminal block 20 that is attached to the side surface of the casing 10. The casing 10 includes a main body that includes a bottom surface and a side wall 11 and a cover portion that covers the main body, but only the main body is illustrated in FIG. 1. Electronic components that constitute the electronic device 100 are disposed inside the casing 10.

The electronic components that are disposed inside the casing 10 are appropriately selected in response to the function of the electronic device 100. For example, in a case where the electronic device 100 is a switching power supply unit, an input capacitor, a switching element, a main transformer, a choke inductor, a control substrate, an output capacitor, and the like are received inside the casing 10, and these components are connected to one another by conductive members such as bus bars having conductivity, so that these components function as the switching power supply unit. In a case where the electronic device 100 is the switching power supply unit, the terminal block 20 is used as an output side terminal block that is connected to, for example, a low-voltage battery.

Further, the electronic device 100 according to the embodiment is appropriately used for a case where airtightness is particularly needed. For example, the case where the airtightness is needed indicates a case where the electronic device 100 is an in-car switching power supply unit and is disposed in an engine room. In this case, since dust or many kinds of liquids such as water, water droplet, rain water, sea water, a radiator liquid, a window washer liquid, and engine oil exist inside the engine room, there is a need to prevent an accident in which such a liquid intrudes into the casing 10 and damages the components inside the casing 10. The terminal block 20 that is attached to the electronic device 100 according to the embodiment has a structure which is appropriately used for a place where such airtightness is needed.

Furthermore, since the electronic device 100 according to the embodiment has the characteristic structure of the terminal block 20 as described above, the components that are received inside the casing 10 of the electronic device 100 are not illustrated in the drawings.

The terminal block 20 is attached to a through-hole 12 that is formed in a plane extending along the YZ plane in the side wall 11 of the casing 10. Further, the side wall 11 is equipped with screw holes 13 and 14 that are formed in the vicinity of the through-hole 12 used for the attachment of the main body of the terminal block 20 in order to screw-fix the terminal block 20 to the side wall 11. In the electronic device 100 according to the embodiment, the through-hole 12 used to attach the main body of the terminal block 20 and the screw holes 13 and 14 used to screw-fix the terminal block 20 serve as attachment portions for the terminal block 20 in the casing 10 of the electronic device 100.

As illustrated in FIGS. 1 to 4, the terminal block 20 that is attached to the through-hole 12 of the side wall 11 includes a substantially cylindrical resinous portion 21 that is formed as an insulating member by resin or the like, a conductive terminal member 23 that is formed of metal or the like and is inserted into the substantially cylindrical resinous portion 21 so as to pass therethrough, and a connection member 25 that is used to connect an external terminal (not illustrated) to the terminal member 23, and is inserted into the through-hole 12 of the side wall 11 in the X direction.

For example, the resinous portion 21 is formed of an insulating material such as a polyphenylenesulfide (PPS) resin and a polybutylene terephthalate (PBT) resin, and includes an insertion portion 21A that is inserted into the through-hole 12 in the X direction, a main body 21B that is formed so as to be continuous in the X direction with respect to the insertion portion 21A, and has a diameter larger than that of the insertion portion 21A, and includes a contact surface 211 abutting against an outer surface 11A of the side wall 11 when the resinous portion is attached to the side wall 11, and a connection wall portion 21C that is formed so as to be continuous in the X direction with respect to the main body 21B and is formed so as to surround the connection member 25 used for the connection with an external terminal.

Among these constituents, the main body 21B is equipped with flanges 212 and 213 that extend from the main body 21B in the YZ plane direction perpendicular to the X direction as the insertion direction of the terminal block 20. Thus, when a screw 32 that is inserted into a through-hole 212A formed in the flange 212 is fixed to the screw hole 13 of the side wall and a screw 33 inserted into a through-hole 213A formed in the flange 213 is fixed to the screw hole 14 of the side wall, the terminal block 20 is fixed to the side wall 11. Further, the terminal block 20 is inserted and attached into the through-hole 12 of the side wall 11 while an O-ring (sealing member) 216 is attached to a groove 215 formed in the insertion portion 21A of the resinous portion 21. Accordingly, a gap between the side wall 11 and the insertion portion 21A in the terminal block 20 is blocked, and a gap between the terminal block 20 and the side wall 11 is sealed, so that the gap is watertightly sealed. In the terminal block 20 according to the embodiment, there is a structural characteristic in the insertion portion 21A of the resinous portion 21 in order to seal the gap among the terminal member 23, the connection member 25, and the resinous portion 21, but this point will be described later.

Figure 5:
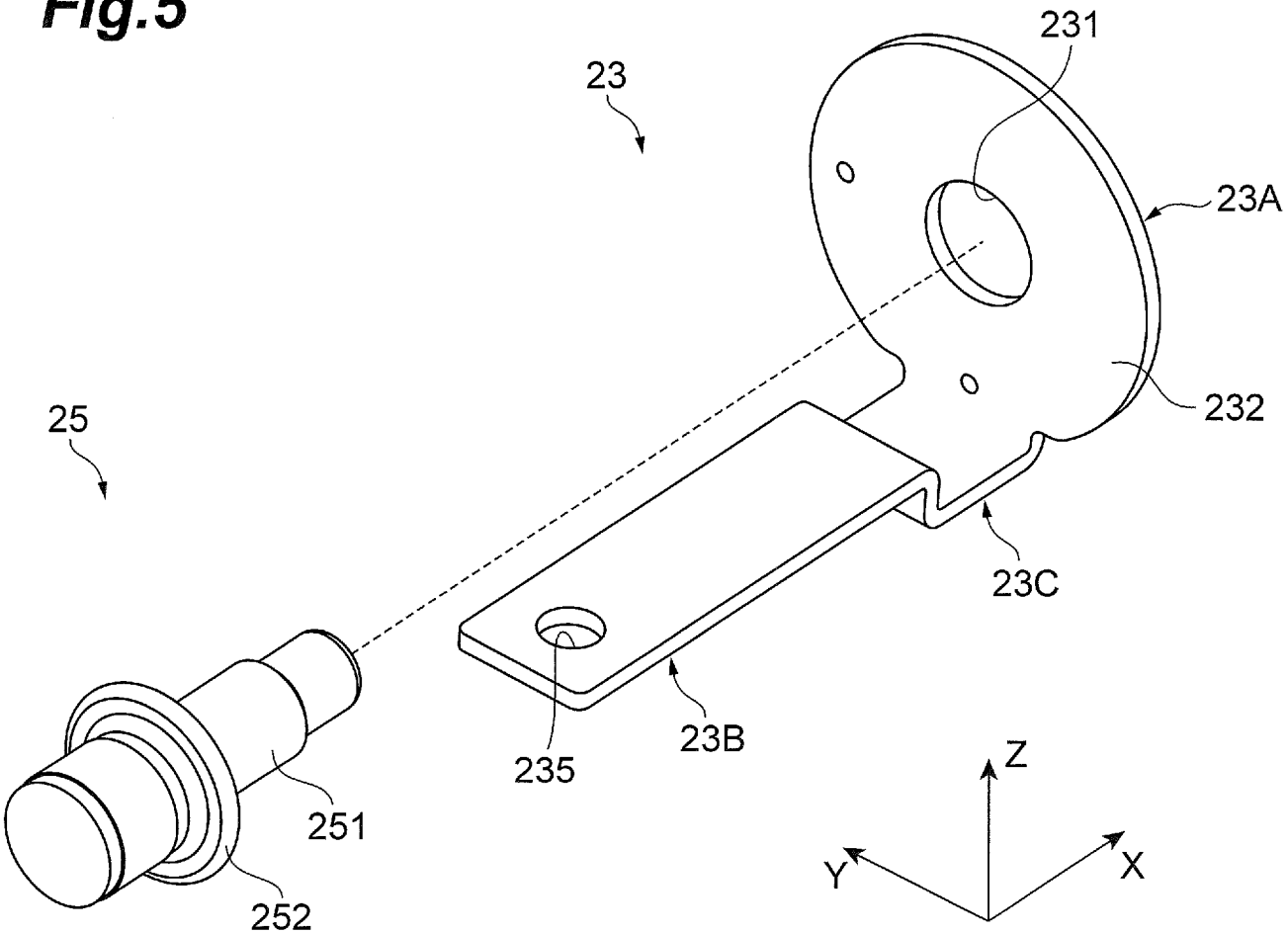
FIG. 5 is a schematic perspective view illustrating a configuration of a terminal member and a connection member.
Figure 6:
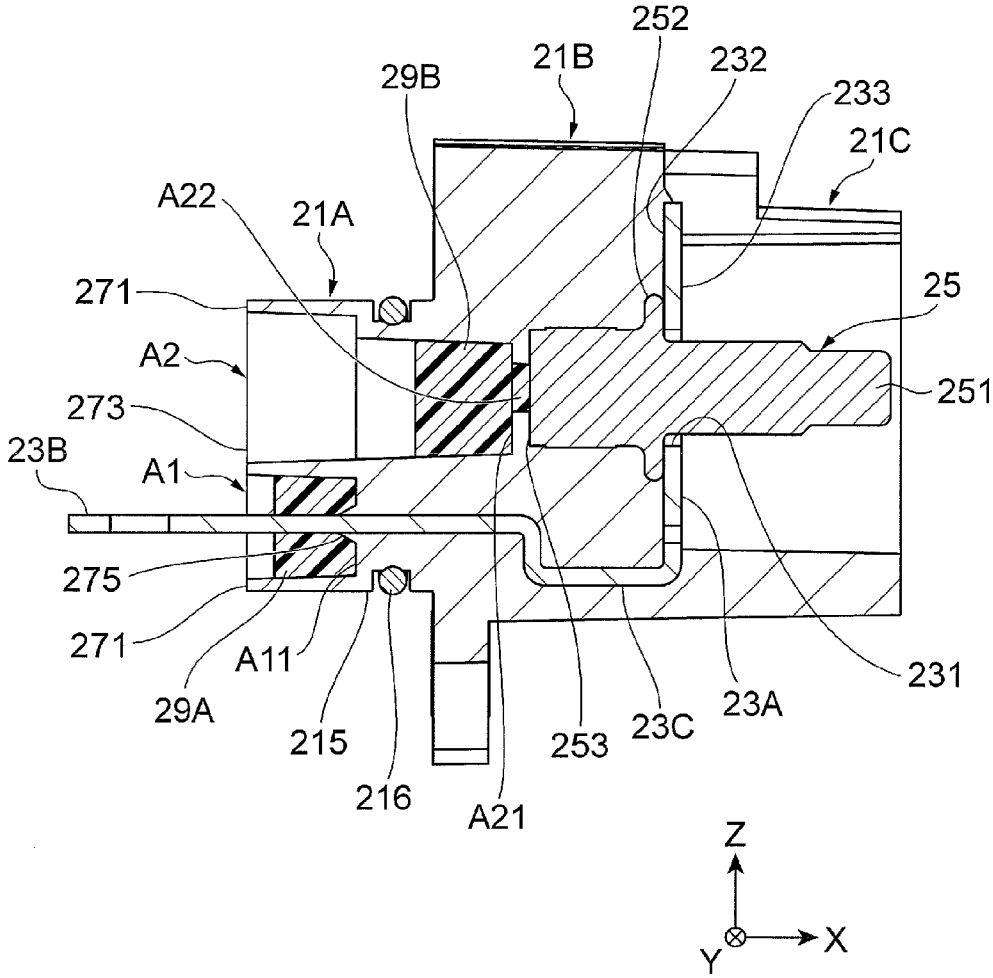
FIG. 6 is a cross-sectional view illustrating the terminal block in which the terminal member and the connection member are fixed by a resinous portion.

Next, the terminal member 23 and the connection member 25 of the terminal block 20 will be described by referring to FIGS. 5 and 6. FIG. 5 is a schematic perspective view illustrating a configuration of the terminal member 23 and the connection member 25, and FIG. 6 is a cross-sectional view of the terminal block 20 in which the terminal member 23 and the connection member 25 are fixed by the resinous portion 21.

As illustrated in FIG. 5, the terminal member 23 includes an outer end 23A (a first terminal) that is one end extending in the X direction as the insertion direction of the terminal block 20 with respect to the casing 10 and is exposed to the outside of the casing 10 so that an external terminal is attached to the outer end through a cable or the like from an external device, an inner end 23B (a second terminal) that is an end opposite to the outer end 23A and is electrically connected to the components inside the casing 10 through the busbars (the conductive members) and the like, and a bent portion 23C that connects the outer end 23A to the inner end 23B. The outer end 23A includes an inner opening 231, and is formed by a donut-shaped flat member extending in the YZ plane. Further, the inner end 23B is formed by a flat member that extends inward in the XY plane, and the end is equipped with an opening 235 that is used to fix the busbar and the like for connecting the internal electronic components to one another. The opening 235 may be replaced by a male screw or a female screw if the screw may be connected to the internal electronic components.

The terminal member 23 may be formed by cutting out one flat conduct material, where the bent portion 23C is an area that is bent so as to connect the outer end 23A parallel to the YZ plane to the inner end 23B extending in the X direction in parallel to the XY plane, and is bent downward in the substantially perpendicular direction when viewed from the inner end 23B parallel to the XY plane, is bent again in the horizontal direction, and is bent upward in the substantially perpendicular direction, thereby forming the outer end 23A parallel to the YZ plane. In the outer end 23A, a surface 232 near the inner end 23B abuts against the connection member 25, and a surface 233 that becomes the rear side of the surface 232 is exposed to the outside and becomes a surface electrically connected to an external device.

The connection member 25 includes a main body 251 that is formed as a substantially columnar iron member extending in the X direction and a substantially circular flange 252 that uniformly extends outward as it goes toward the main body 251 in the X direction. The connection member 25 is installed so that the main body 251 is inserted through the opening 231 formed in the outer end 23A of the terminal member 23 from the inner end 23B. The flange 252 holds the terminal member 23 and the connection member 25 while contacting the surface 232 of the outer end 23A, the terminal member 23 and the connection member 25 are covered by the resinous portion 21, and the resinous portion 21 is hardened so as to fix the terminal member 23 and the connection member 25. Furthermore, a configuration has been described in which the main body 251 of the connection member 25 is formed as an iron member, but for example, an insulation member such as resin may be used as long as a desired mechanical strength is ensured.

Returning to FIG. 1, the connection wall portion 21C of the resinous portion 21 is formed so as to surround the end near the outer end 23A of the connection member 25 while the surface 233 of the outer end 23A of the terminal member 23 is exposed. The shape of the connection wall portion 21C is changed in response to the shape and the like of the connector of the external device connected to the outer end 23A. In a case of the terminal block 20 according to the embodiment, when the connector of the external device is attached between the connection member 25 and the connection wall portion 21C and the conductive terminal included in the connector contacts the surface 233 of the outer end 23A of the terminal member 23, the terminal is electrically connected to the external device.

Figure 7:
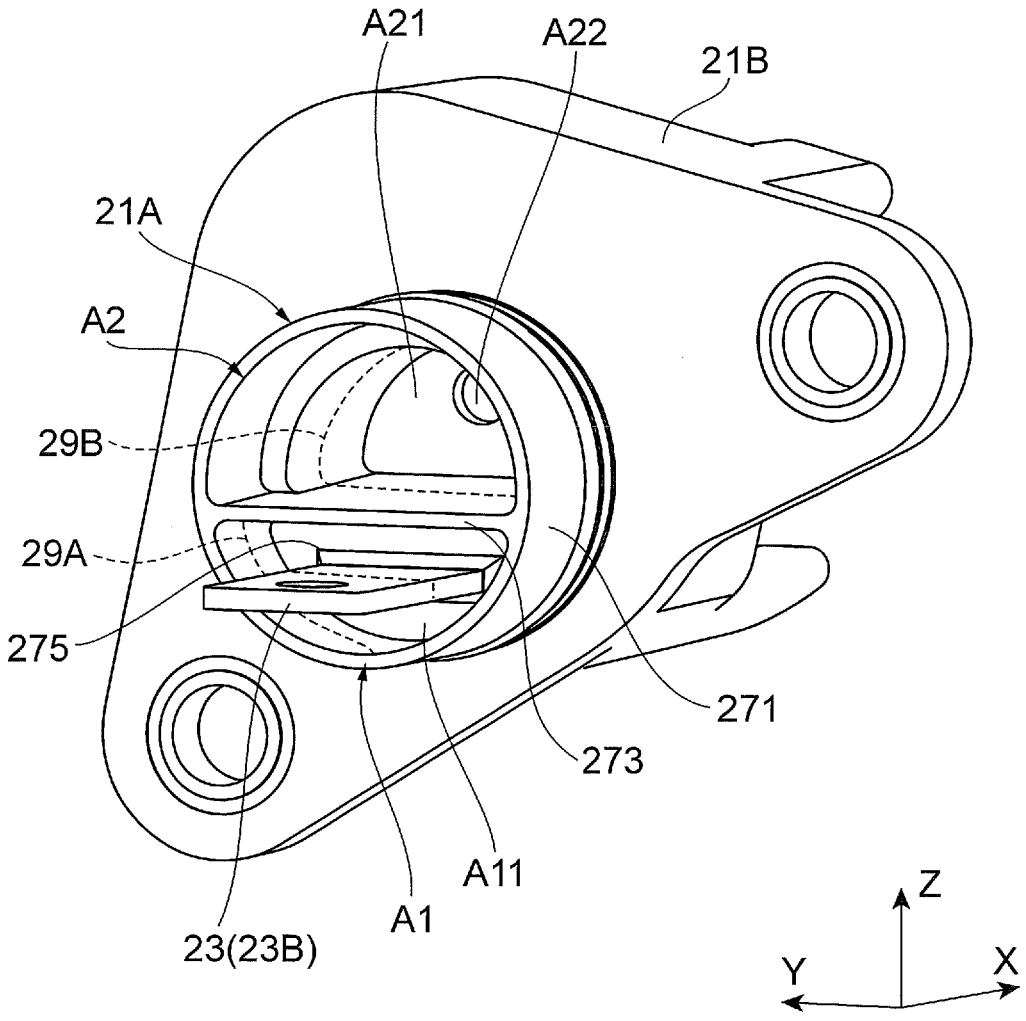
FIG. 7 is a schematic perspective view of the terminal block when viewed from an insertion portion.

Here, the shape of the insertion portion 21A as one technical characteristic portion of the terminal block 20 according to the embodiment will be described by mainly referring to FIGS. 4, 6, and 7. FIG. 7 is a schematic perspective view illustrating the side of the insertion portion 21A according to the terminal block 20.

In the insertion portion 21A of the resinous portion 21 of the terminal block 20, as illustrated in FIG. 6, the inner end 23B of the terminal member 23 is exposed at a position separated from a peripheral edge 271 inside the substantially cylindrical peripheral edge 271 forming the outer shape of the insertion portion 21A. Further, the inside of the peripheral edge 271 of the insertion portion 21A is equipped with a partition wall 273. Accordingly, the inside of the insertion portion 21A is divided as a first area Al that is surrounded by the partition wall 273 and the peripheral edge 271 and has a recessed shape from which the inner end 23B of the terminal member 23 is exposed from the inner bottom surface A11 and as a second area A2 that is formed in a recessed shape surrounded by the partition wall 273 and the peripheral edge 271 as not in the first area A1. The ends near the inner end 23B of the first area A1 and the second area A2 are opened, and the end of the main body 21B near the connection wall portion 21C is closed, thereby forming a recessed shape.

A bottom surface A21 of the second area A2 is provided with a through-hole A22 that communicates with an end surface 253 near the insertion portion 21A of the connection member 25. In order to harden the resin of the resinous portion 21 while the arrangement of the terminal member 23 and the connection member 25 illustrated in FIG. 6 is maintained, the through-hole A22 is used to bring the flange 252 of the connection member 25 into contact with the surface 232 of the terminal member 23. That is, the through-hole A22 is used to fix the terminal member 23 and the connection member 25 in the state illustrated in FIG. 6.

In the terminal block 20 with the above-described configuration, there has been a demand for improving the airtightness of the inside (the side of the inner end 23B of the terminal member 23) of the casing 10 with respect to the outside (the side of the outer end 23A of the terminal member 23) thereof. In the terminal block 20 according to the embodiment, it is considered that an external leakage may occur at the boundary faces of the terminal member 23, the connection member 25, and the resinous portion 21. Specifically, it is considered that the leakage may occur in a route extending from the opening 231 of the terminal member 23 to the through-hole A22 of the connection member 25 in the periphery of the connection member 25 illustrated in FIG. 6, a route extending from the opening 231 of the terminal member 23 to the first area A1 along the boundary between the terminal member 23 and the resinous portion 21, and a route extending from the surface 233 of the terminal member 23 to the first area A1 along the terminal member 23.

Therefore, these areas are individually sealed by charging each of the first area A1 and the second area A2 surrounded by the peripheral edge 271 and the partition wall 273 through charging resins 29A and 29B different from that of the resinous portion 21. Accordingly, even when the leakage occurs along the routes that may cause the above-described leakage, the leakage is sealed by the charging resins 29A and 29B. Accordingly, it is possible to prevent the occurrence of the leakage between the outside and the inside of the terminal block 20 along the boundary faces of the terminal member 23, the connection member 25, and the resinous portion 21. Furthermore, an epoxy resin is appropriately used as the charging resin.

Further, in an area in which the terminal member 23 is exposed from the resinous portion 21 on the bottom surface A11 of the first area A1, a padding portion 275 which is formed by piling a resin in an inclined state is provided so as to prevent the separation from the resinous portion 21 and the terminal member 23. Further, the height of the padding portion 275 from the bottom surface A11 in the X direction is lower than the height of the peripheral edge 271 from the bottom surface A11. Accordingly, in a case where the charging resin 29A is charged into the first area A1, it is possible to prevent the padding portion 275 from being exposed to the surface of the charging resin 29A.

In the terminal block 20 of the electronic device 100 according to the embodiment, since the first area A1 and the second area A2 are divided by the partition wall 273, the position of the bottom surface A11 of the first area A1 and the position of the bottom surface A21 of the second area A2 may be different in the extension direction (the X direction) of the terminal member 23. Accordingly, the respective charging amounts of the charging resins in the first area A1 and the second area A2 may be appropriately adjusted. For example, since the terminal block 20 has a structure in which the connection member 25 protrudes toward the outer end 23A of the terminal member 23 as illustrated in FIG. 6, the position of the end surface 253 of the connection member 25 near the inner end 23B is largely different from the position of the inner end 23B of the terminal member 23 in the X direction.

Here, in a case where the first area A1 and the second area A2 are formed as one recessed portion without being defined by the partition wall 273, there is a need to block the boundary portion (the portion provided with the padding portion 275) between the terminal member 23 and the resinous portion 21 while blocking the through-hole A22 communicating with the end surface 253 of the connection member 25 by the charging resin, a considerable amount of the charging resin is needed. The charging resin that is used to improve the airtightness is expensive, and an increase in usage amount directly leads to the terminal block manufacturing cost.

On the contrary, in the terminal block 20 of the electronic device 100 according to the embodiment, since the first area A1 and the second area A2 are divided by the partition wall 273, it is possible to individually charge the charging resin 29A for blocking the through-hole A22 and the charging resin 29B for blocking the boundary portion between the terminal member 23 and the resinous portion 21. Thus, since the charging amounts of the charging resins 29A and 29B may be respectively adjusted, it is possible to appropriately charge the charging resin for improving the airtightness and to reduce the usage amount of the charging resin used for the sealing operation.

Further, in the terminal block 20 of the electronic device 100 according to the embodiment, since the bent portion 23 is formed between the outer end 23A and the inner end 23B, the shape of the terminal member 23 between the outer end 23A and the inner end 23B may be formed in a bent shape instead of a linear shape. Accordingly, it is possible to prevent the occurrence of the leakage along the boundary face between the terminal member 23 and the resinous portion 21 and hence to improve the airtightness of the terminal block 20.

Hereinbefore the embodiment of the present invention has been described above, but the electronic device 100 according to the present invention may be modified into various forms. For example, in the above-described embodiment, a case has been described in which the outer end 23A of the terminal member 23 is bent to a plane extending in the substantially perpendicular direction, but the extension direction of the outer end 23A may not be the perpendicular direction. Similarly, the shapes of the terminal member 23 and the connection member 25 may be appropriately changed. For example, a configuration has been described in which the terminal member 23 includes the bent portion 23C, but the terminal member 23 may not include the bent portion 23C. Further, the terminal member 23 may not be formed by the flat member. Further, the bent portion 23C of the terminal member 23 may be formed in an inclined shape. Further, the connection member 25 may be not a male screw, but a female screw.

Further, in the above-described embodiment, a case has been described in which the terminal member 23 of the terminal block 20 has a function of outputting a current flowing inside the casing 10 to another external device, but the terminal member may be used as an input terminal that inputs an external current to the components inside the casing 10. Even in this case, since the airtightness with respect to the outside needs to be improved, when the structure illustrated in the above-described embodiment is employed, the usage amount of the resin for improving the airtightness and the sealing operation may be reduced.

Further, in the above-described embodiment, the configuration of the casing 10 and the like included in the electronic device 100 may be appropriately changed. Further, a cooling unit for cooling the internal electronic components and the like may be installed in the casing 10.

Further, the electronic device 100 is not limited to the switching power supply unit. That is, the electronic device 100 according to the embodiment is not particularly limited as long as the terminal block 20 is used so as to electrically connect the inside of the electronic device to another electronic device.

What is claimed is:

1. A terminal block comprising:

a terminal member of which one end side is equipped with a first terminal having an opening and the other end side different from the one end side is equipped with a second terminal;

a connection member that includes a flange extending outward from about a center of a main body and is inserted from the side of the second terminal into the opening of the first terminal of the terminal member so that the flange is fixed while contacting the first terminal; and a resinous portion that covers the peripheries of the terminal member and the connection member while at least one of the first terminal and the connection member is exposed at the side of the first terminal and the second terminal is exposed at the side of the second terminal, wherein the resinous portion includes a cylindrical side wall that is formed at the end of the side of the second terminal so as to extend toward the side of the second terminal in the extension direction of the terminal member and to surround the terminal member and a partition wall that divides an area surrounded by the side wall into a first area and a second area, wherein the terminal member protrudes from a bottom surface of the first area, and wherein a bottom surface of the second area is provided with a through-hole communicating with an end surface the side of the second terminal of the connection member.

2. The terminal block according to claim 1, wherein a padding portion is formed in a boundary portion between the terminal member and the resinous portion at the bottom surface of the first area, and wherein the height of the padding portion in the extension direction of the terminal member is lower than the height of the side wall.

3. The terminal block according to claim 1, further comprising:

a charging resin that is charged into the first area and the second area.

4. The terminal block according to claim 3, wherein a charging amount of the charging resin is different in the first area and the second area.

5. The terminal block according to claim 1, wherein the terminal member includes a bent portion that is formed between the first terminal and the second terminal.

6. An electronic device comprising:

the terminal block according to claim 1;

a casing that includes an attachment portion for attaching the terminal block thereto and accommodates an electronic component electrically connected to the terminal block therein; and a sealing member that blocks a gap between the casing and the terminal block at the attachment portion.

7. The terminal block according to claim 2, further comprising:

a charging resin that is charged into the first area and the second area.

8. The terminal block according to claim 7, wherein a charging amount of the charging resin is different in the first area and the second area.

9. The terminal block according to claim 2, wherein the terminal member includes a bent portion that is formed between the first terminal and the second terminal.

10. The terminal block according to claim 3, wherein the terminal member includes a bent portion that is formed between the first terminal and the second terminal.

11. The terminal block according to claim 4, wherein the terminal member includes a bent portion that is formed between the first terminal and the second terminal.

12. The terminal block according to claim 7, wherein the terminal member includes a bent portion that is formed between the first terminal and the second terminal.

13. An electronic device comprising:

the terminal block according to claim 2;

a casing that includes an attachment portion for attaching the terminal block thereto and accommodates an electronic component electrically connected to the terminal block therein; and a sealing member that blocks a gap between the casing and the terminal block at the attachment portion.

14. An electronic device comprising:

the terminal block according to claim 3;

a casing that includes an attachment portion for attaching the terminal block thereto and accommodates an electronic component electrically connected to the terminal block therein; and a sealing member that blocks a gap between the casing and the terminal block at the attachment portion.

15. An electronic device comprising:

the terminal block according to claim 4;

a casing that includes an attachment portion for attaching the terminal block thereto and accommodates an electronic component electrically connected to the terminal block therein; and a sealing member that blocks a gap between the casing and the terminal block at the attachment portion.

16. An electronic device comprising:

the terminal block according to claim 5;

a casing that includes an attachment portion for attaching the terminal block thereto and accommodates an electronic component electrically connected to the terminal block therein; and a sealing member that blocks a gap between the casing and the terminal block at the attachment portion.

* * * * *